United States Patent [19]

Du Bois et al.

[11] 4,300,710

[45] Nov. 17, 1981

[54] CONTINUOUS FORM FEEDER

[75] Inventors: R. Clark Du Bois, Fairfield; John Hamma, Milford, both of Conn.

[73] Assignee: Gradco-Dendoki, Inc., Newport Beach, Calif.

[21] Appl. No.: 98,539

[22] Filed: Nov. 29, 1979

[51] Int. Cl.[3] ..... G03B 1/30; G03G 15/00

[52] U.S. Cl. ..... 226/74; 355/14 R; 355/75

[58] Field of Search ..... 226/74, 75, 76, 79, 226/129; 355/14, 50, 195 H, 75

[56] References Cited

U.S. PATENT DOCUMENTS

| | | | |
|---|---|---|---|
| 3,281,037 | 10/1966 | Young | 226/76 |
| 3,446,554 | 5/1969 | Hitchcock | 355/75 |
| 3,578,138 | 5/1971 | Cantwell | 226/74 |
| 3,997,093 | 12/1976 | Aizawa | 226/11 |
| 4,010,882 | 3/1977 | Turner | 226/11 |
| 4,087,172 | 5/1978 | Dongen | 226/79 |
| 4,189,078 | 2/1980 | Spisz | 226/74 |

*Primary Examiner*—Edward J. McCarthy
*Attorney, Agent, or Firm*—Newton H. Lee, Jr.

[57] ABSTRACT

A continuous fan-folded form feeder is applied to a copying machine and has a receiver for the folded form from which the form is trained over the top of the copying machine platen and then beneath the platen to the rear of the copying machine for engagement by form tractors to be progressively fed in stages beneath the platen to a re-fold tray. Drive means for the tractors feeds the form step-by-step in selected increments of length.

12 Claims, 9 Drawing Figures

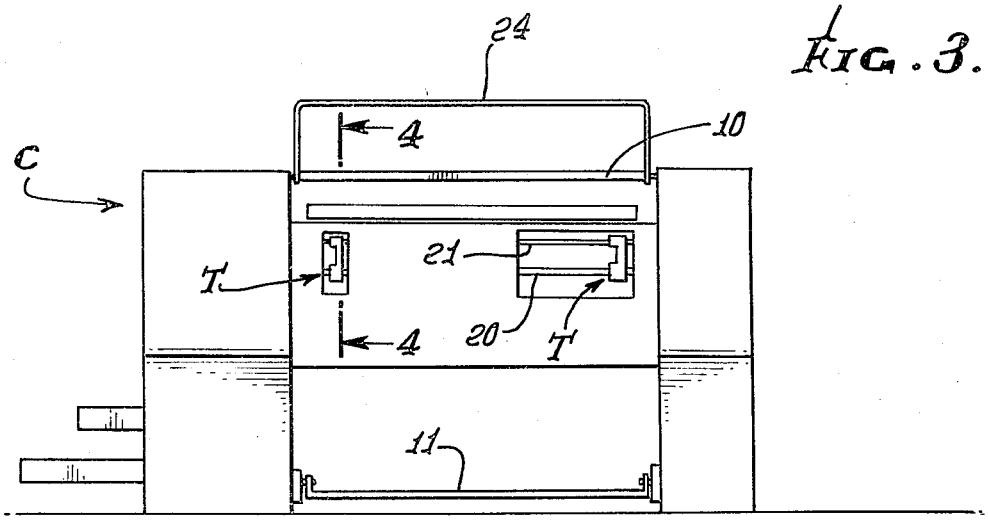
FIG. 3.
FIG. 4.
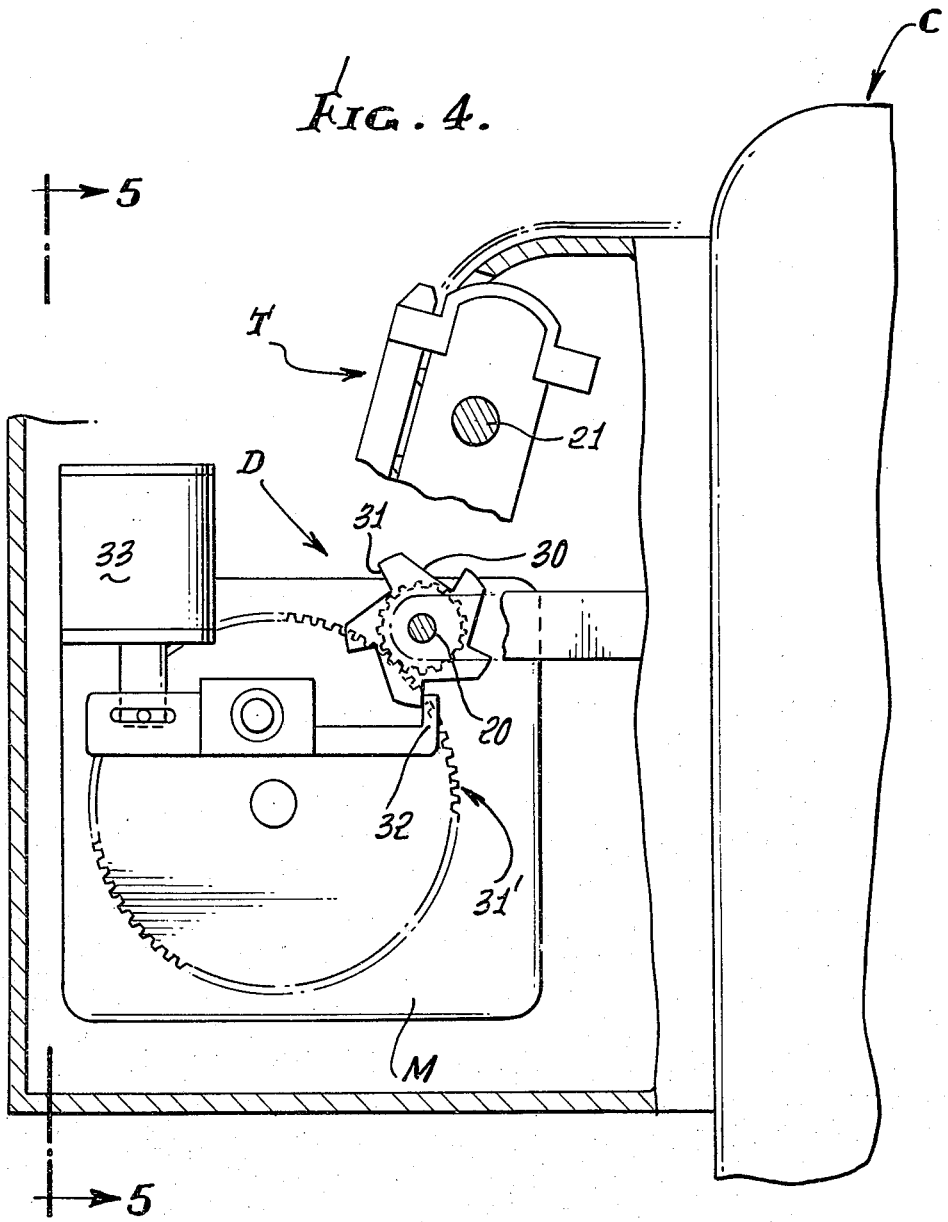

CONTINUOUS FORM FEEDER

BACKGROUND OF THE INVENTION

Continuous or fan-folded computer forms are well known and have a computer print out applied to sheets which are interconnected at reverse folds along top and bottom edges of the sheets. The side edges of the sheets are perforated to receive cogs or drive belts of tractor devices which are adapted to transport the fan-folded form.

From time-to-time, it is desired that a duplicate or plural copies of the computer print out form be made, but manual handling of the folded form is time-consuming and unwieldy.

It has been proposed that an attachment be provided for use with copying machines, the attachment having drive means for the form enabling the form to be progressively fed beneath the platen of the copier in responses to the traverse of the scan light of the copier, so that the form can be copied and refolded. While such an attachment has general applicability to copiers, by adaptation of the supporting means, there remains a need for a fan-folded form feeder which can be readily applied to existing copiers or incorporated into new copiers and which is compact, reliable and easy to use.

SUMMARY OF THE INVENTION

An object of the present invention is to provide improved fan-folded form feeding apparatus for copying machines.

Another object is to provide such apparatus which can be easily installed on the copying machine and adapted to transport fan-folded forms of different widths and/or lengths.

In accomplishing the foregoing, apparatus is provided which includes a mounting plate applicable to the rear of a copying machine and having a pair of laterally spaced form tractors supported on the plate for relative lateral adjustment, the tractors being driven by a power source under control of selective means operable to move a selected length of the form over the copying machine from a form receiver to a refold tray.

Since the form feeder may not be desired at all times, the receiver tray and refold tray are foldable to a compact state, enabling the copying machine to be located closely adjacent to a wall, for use of the copier in the usual manner.

The drive means for the tractors, according to this invention are driven by an electric motor which drives the tractor drive shaft through a slip clutch and the shaft is stopped by a stop mechanism to assume correct registry of the form on the copying machine.

In addition, the angular travel of the drive shaft for the tractors is determined by selected cam operated switches which control operation of the motor and stop mechanism.

This invention possesses many other advantages and has other purposes which may be made more clearly apparent from a consideration of the forms in which it may be embodied. The preferred form is shown in the drawings accompanying and forming part of the present application. It will now be described in detail, for the purpose of illustrating the general principals of the invention; but it is to be understood that such detailed description is not to be taken in a limiting sense.

BRIEF DESCRIPTION OF THE DRAWINGS

FIG. 3 is a rear elevation;

FIG. 4 is an enlarged fragmentary section on the line 4—4 of FIG. 3;

DESCRIPTION OF THE PREFERRED EMBODIMENT

Figure 1:
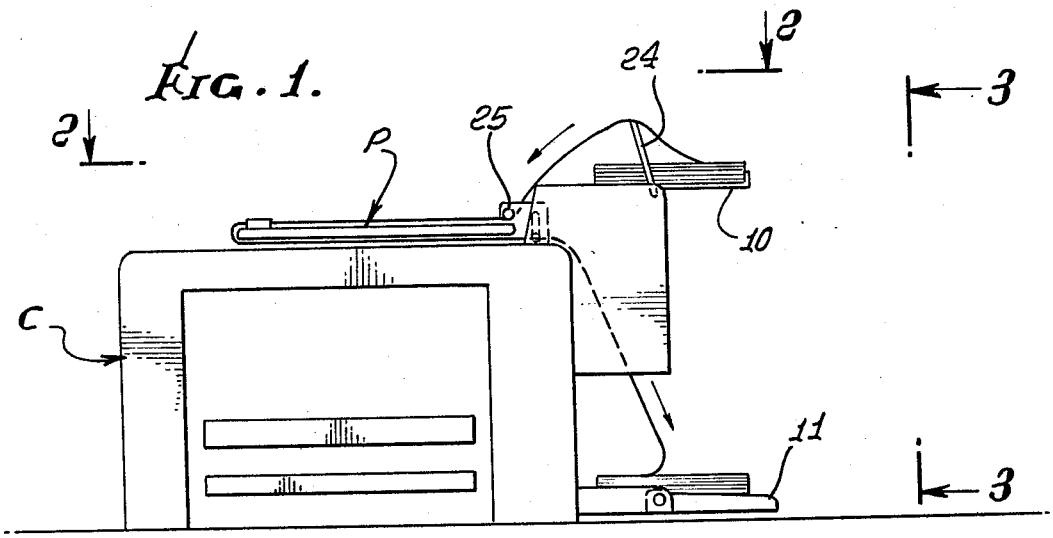
FIG. 1 is a side elevation showing the form feeder applied to a copier of FIG. 3.

Fan-folded form copying apparatus, as seen in the drawings, comprises a copier C for making successive copies of original sheets, a platen P pivotally mounted on the copier, a form receiving tray 10 disposed horizontally above and rearwardly of the platen, and a form refolding tray 11 disposed horizontally below the platen and rearwardly of the copier. Means are provided for guiding the form, as shown in FIG. 1, from said receiving tray across the platen and beneath the platen to the rear of the copier. Intermittently operable drive means D (FIG. 5) are provided for progressively feeding the form beneath the platen to the rear of the copier for gravitation to said refolding tray.

The drive means includes laterally spaced drive tractors T including driven members 12 having pins 13 engageable in perforations in the side edges of the form, and as later described, the tractors are laterally adjustably mounted for adjustment to drive forms of different widths.

The drive means has selective control means shown in FIGS. 5 and 6 to cause intermittent feeding of different lengths of said form as also later described.

Figure 5:
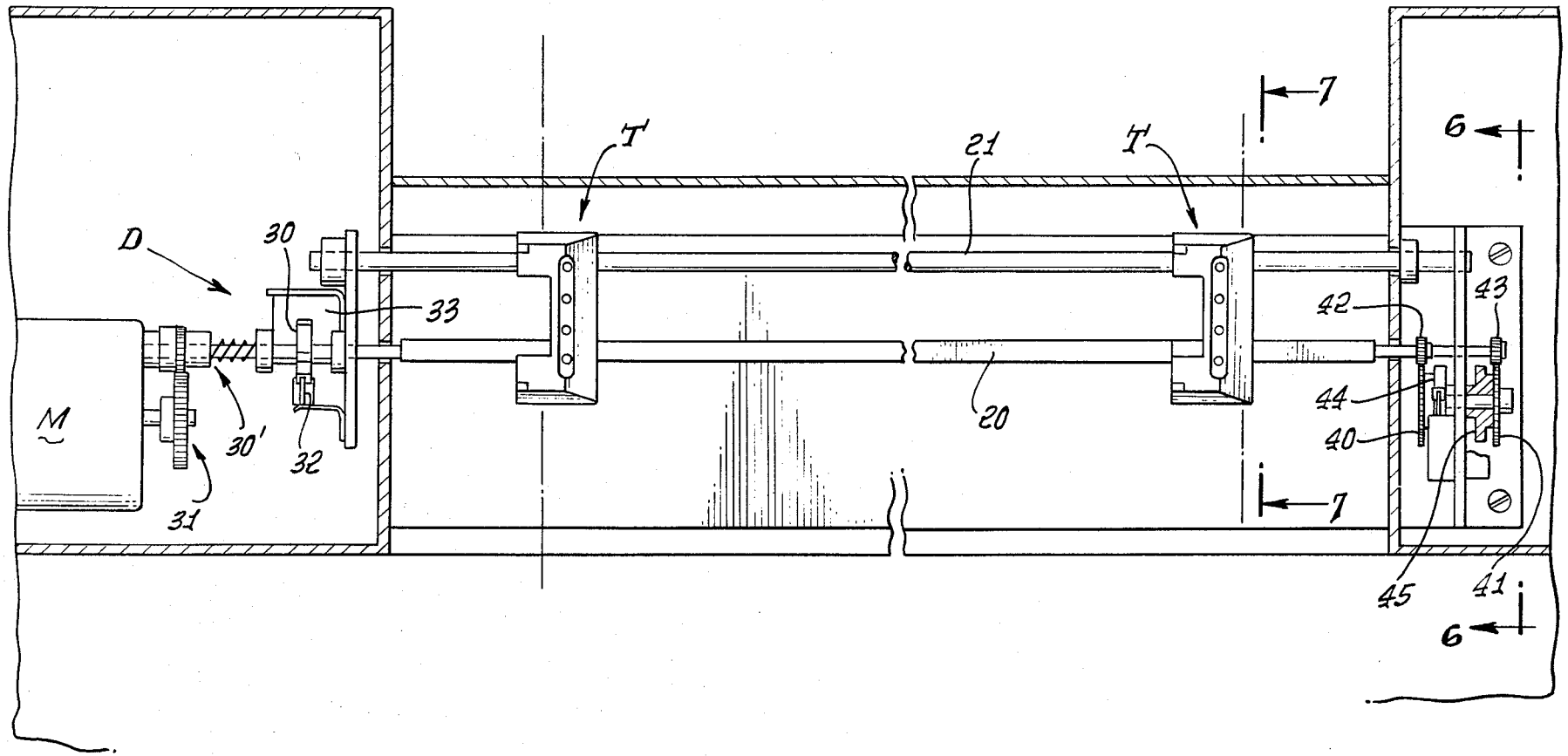
FIG. 5 is a fragmentary view on the plane of the line 5—5 of FIG. 4, showing the form transport means.

Referring to FIG. 5, the tractors T are mounted upon a square shaft 20 and an upper guide shaft 21. The square shaft 20 is driven by a motor M under the control of the system shown in FIG. 9.

Figure 7:
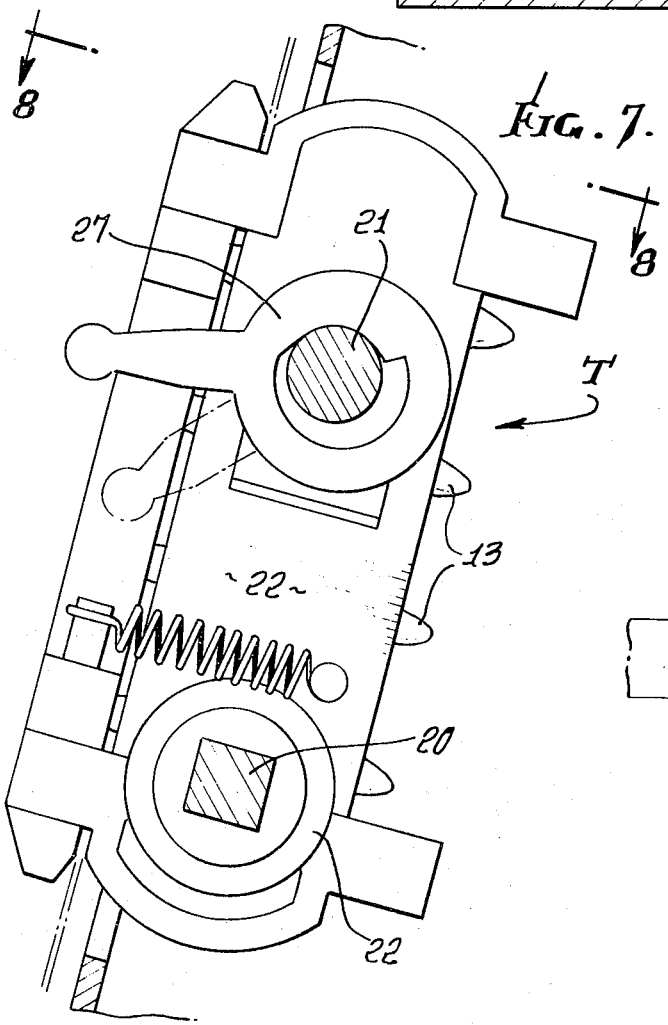
FIG. 7 is a vertical section on the line 7—7 of FIG. 5.
Figure 8:
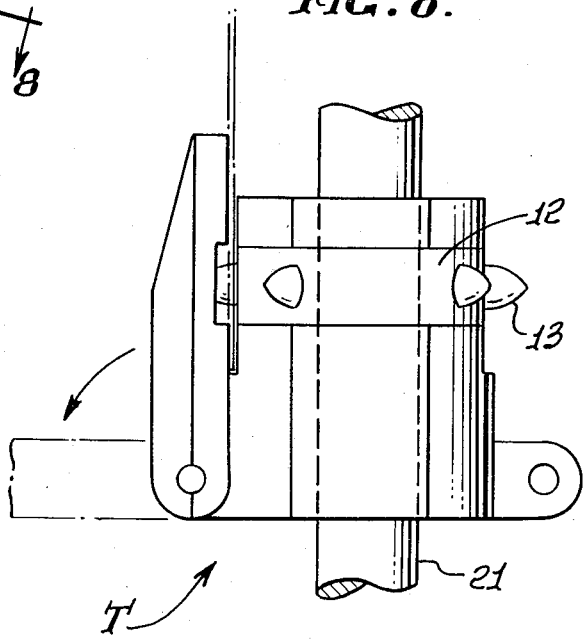
FIG. 8 is a section on the line 8—8 of FIG. 7, showing the tractor open.

Referring to FIG. 7, each tractor T will be seen to comprise a body 22 containing sprockets over which a drive belt 12 extends, the drive belt having the above described pins 13. The lower sprocket 22 is driven by the square drive shaft 20, whereby the form engaged by the pins 13 is transported from the receiving tray 10, moving upwardly over an upstanding transversely extending bail 24 thence forwardly and downwardly beneath a rod 25 extending horizontally just above the rear portion of the platen P, the form then extending beneath the platen for reproduction, thence engaging the tractors, at the rear of the copier, from which the form moves gravitationally onto the rear flat tray 11, all as seen in FIG. 1.

Figure 2:
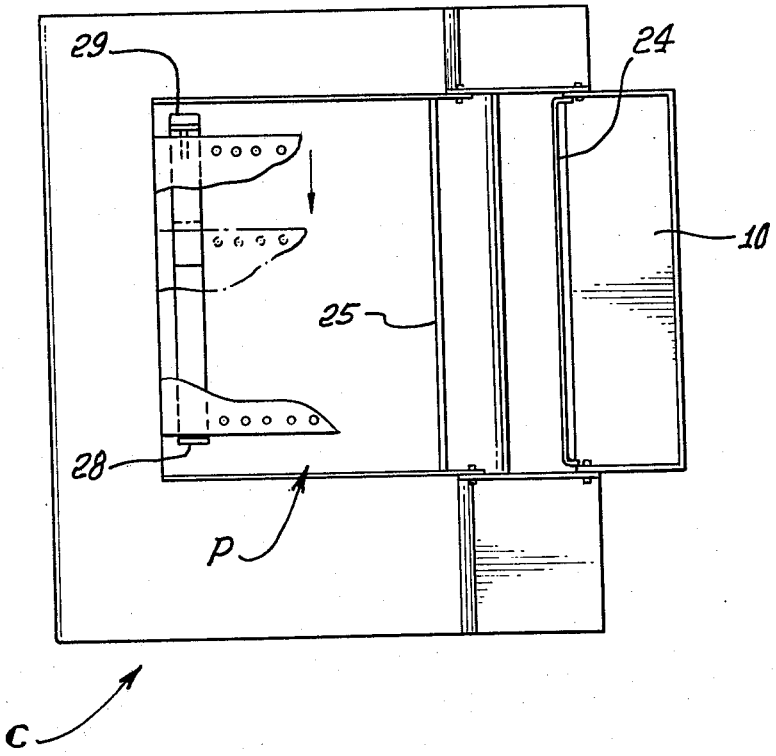
FIG. 2 is a top plan.

The right hand tractor T of FIG. 5 is laterally adjustable along the shafts 20 and 21, when a cam lock 27 on the tractor is released from engagement with the guide shaft 21. This enables the pair of tractors to engage forms of different widths. In this connection, it will also be seen in FIG. 2 that the platen has a fixed marginal guide 28 on its upper surface opposed by a laterally adjustable marginal guide 29, whereby to guide the forms of different widths, one of which is seen in full lines and one of which is seen in broken lines.

Referring to FIGS. 4 and 5, means are shown for stopping movement of the drive shaft 20 at fixed locations coinciding with the spacing of the perforations in the margins of the form. The stop means includes a cog wheel 30 on shaft 20 for rotation therewith, the wheel having a number of lugs providing radial faces 31 engageable by a pivoted pawl or detent 32. The pawl is adapted to be disengaged from the cog wheel by a solenoid 33. This stop means positively stops rotation of shaft 20, and a slip clutch 30' is mounted on the drive shaft 20 to normally drive the latter through motor driven gearing 31' when the pawl is released from the cog wheel, but when the pawl engages the cog wheel, the slip clutch 30' permits the motor to overrun without changing the location of the form.

Figure 6:
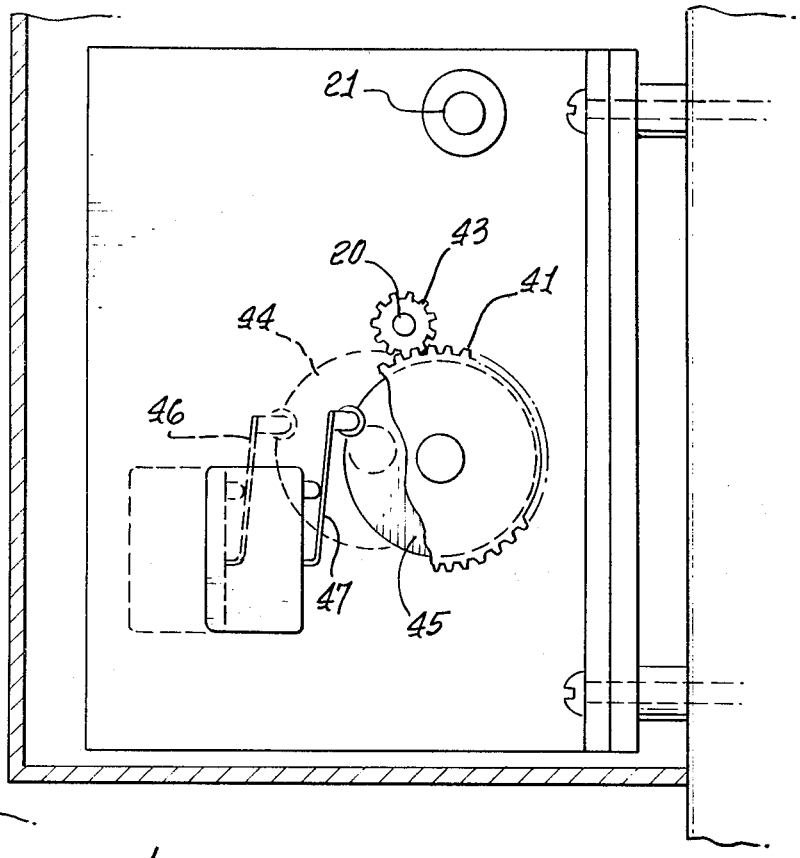
FIG. 6 is a vertical section on the line 6—6 of FIG. 5.

In addition, as best seen in FIGS. 5 and 6, means are provided for causing the drive shaft 20 to be stopped following different degrees of angular travel whereby different lengths of the form can be transported through the copier.

A pair of gears 40 and 41 are in mesh with gears 42 and 43 on the drive shaft 20 to drive a pair of switch actuator cams 44 and 45. The ratio of the gears 40, 42 and 41, 43 is such that the cams 44 and 45 revolve differentially. Switch arms 46 and 47 are actuated by the cams 44 and 45, respectively, to close the switches or to allow the switches to open following one revolution of the cam. As will later become apparent, opening of these control switches de-energizes the motor M and the pawl solenoid so that the drive shaft is instantaneously stopped, but as pointed out above, the motor can overrun.

From the foregoing, it will be apparent that the number of cogs in cog wheel 30 and the angular extent of rotation of the switch operating cams are so related to the tractor pin spacing that precise lengths of form will be transported with each shaft revolution.

Figure 9:
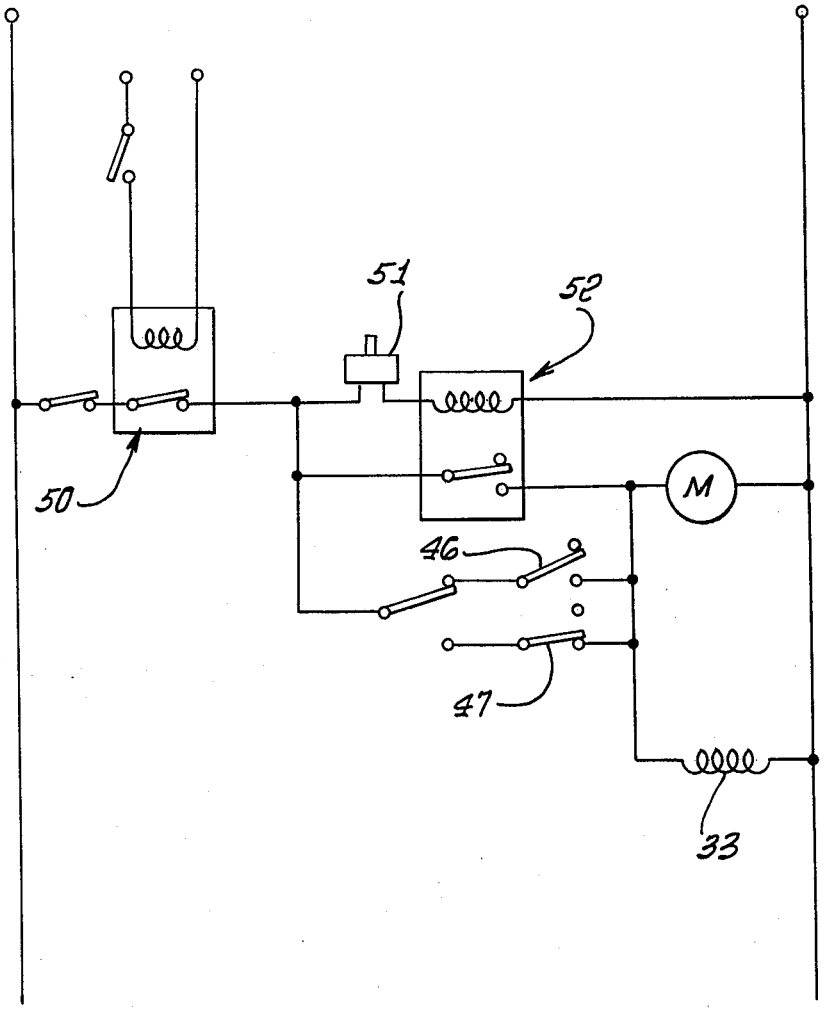
FIG. 9 is a diagram of the control system.

The cycling or intermittent operation of the transport is timed to the copy cycle of the copying machine. Referring to FIG. 9, a diagrammatic illustration of the control system is shown wherein the scanning lamp voltage of the copier is employed to energize a normally closed relay 50. When relay 50 is closed, current is supplied through a time delay device 51 to a normally closed relay 52, and through one of the selective cam operated switches 46 and 47 to the motor and to the pawl solenoid 33. The time delay 51 enables the motor to be started by current supplied through normally closed relay 52, thereby causing the selected cam operated switch 46 and 47 to be activated to the closed condition, whereby current is continued to the motor after normally closed relay 52 opens.

From the foregoing, it will be apparent that the invention provides a compact and simple form feeder to be combined with the copier to facilitate the reproduction of the fan-folded form.

When the form feeder is not in use, the copier can be used in a conventional manner, at which time an outer tray section of the refold tray 11 can be pivoted upwardly to an out-of-the-way position. Likewise, the receiver tray 10 can be pivoted to a position on top of the transport housing.

We claim:

1. Fan-folded form copying apparatus comprising a copier for making successive copies of original sheets, a platen pivotally mounted on said copier; a fan-folded form receiving tray disposed horizontally above and rearwardly of said platen; a form refolding tray disposed horizontally below said platen and rearwardly of said copier; means for guiding the form from said receiving tray across said platen and beneath said platen to the rear of said copier; intermittently operable drive means for progressively feeding said form beneath said platen to the rear of said copier for gravitation to said refolding tray and means for mounting said drive means on the rear of said copier intermediate said receiving tray and said refolding tray.

2. The copying apparatus of claim 1; said drive means including laterally spaced drive members having pins engageable in perforations in the side edges of said form, and means laterally adjustably mounting said drive means for adjustment to drive forms of different widths.

3. The copying apparatus of claim 1; said drive means having selective control means to cause intermittent feeding of different lengths of said form.

4. The copying apparatus of claim 1; said drive means including laterally spaced drive members having pins engageable in perforations in the side edges of said form, and means laterally adjustably mounting said drive means for adjustment to drive forms of different widths, said platen having laterally adjustable form guide means on its upper surface for guiding forms of different widths.

5. The copier of claim 1; said guide means including a bail extending horizontally above and forwardly of said receiving tray, for movement of the form over the bail, a bar extending transversely above said platen and below and forwardly of said bail, for movement of the form from above the bail in a path beneath said bar and across said platen.

6. The copying apparatus of claim 1; said drive means including laterally spaced drive members having pins engageable in perforations in the side edges of said form, and means laterally adjustably mounting said drive means for adjustment to drive forms of different widths, said guide means including a bail extending horizontally above and forwardly of said receiving tray, for movement of the form over the bail, a bar extending transversely above said platen and below and forwardly of said bail, for movement of the form from above the bail in a path beneath said bar and across said platen, and said platen having a pair of side guides for directing the path of said form, means mounting one side guide for adjustment laterally of said platen to correspond with the position of said adjustable drive means.

7. Continuous fan-folded form feeding apparatus applicable to a copying machine comprising: a plate adapted to be mounted at the rear of the copying machine, an elongated drive shaft rotably supported on said plate, a pair of laterally spaced form tractor means driven by said shaft and anchored on said plate; a motor for driving said shaft, control means to energize said motor to drive said shaft and shift said form incrementally; a platen pivotally supported by said plate to extend across the top of the copying machine, form receiving and refolding trays carried by said plate, and guide means to direct a form about said platen upon operation of said motor.

8. The form feeding apparatus of claim 7; said control means including selective means for de-energizing said motor following selected movement of said form.

9. The form feeding apparatus of claim 7; said control means including selective means for de-energizing said motor following selected movement of said form, stop means for arresting rotation of said shaft when said motor is de-energized.

10. Continuous fan-folded form feeding apparatus applicable to a copying machine comprising: a plate adapted to be mounted at the rear of the copying machine, an elongated drive shaft rotatably supported on said plate, a pair of laterally spaced form tractor means driven by said shaft and anchored on said plate; a motor for driving said shaft, control means to energize said motor to drive said shaft and shift said form incrementally; said control means including selective means for de-energizing said motor following selected movement of said form, stop means for arresting rotation of said shaft when said motor is de-energized, and overrunning clutch means between said motor and said shaft operable when said shaft is stopped.

11. The form feeding apparatus of claim 7; including means for adjusting the position of one of said tractor means laterally on said shaft relative to the other tractor means.

12. Continuous fan-folded form feeding apparatus applicable to a copying machine comprising: a plate adapted to be mounted at the rear of the copying machine, an elongated drive shaft rotatably supported on said plate, a pair of laterally spaced form tractor means driven by said shaft and anchored on said plate; a motor for driving said shaft, control means to energize said motor to drive said shaft and shift said form incrementally; including housing means for said tractor means and motor, a platen pivotally mounted on said housing means to extend above the copier, form receiving tray means on said housing means, and form refolding tray means mounted on said plate.

* * * * *